United States Patent [19]

Shore

[11] 4,352,575

[45] Oct. 5, 1982

[54] RIBBON CARTRIDGE AND ADAPTER

[76] Inventor: Sydney Shore, 38-04 48th St., Long Island City, N.Y. 11104

[21] Appl. No.: 195,025

[22] Filed: Oct. 8, 1980

[51] Int. Cl.[3] ..... B41J 35/28

[52] U.S. Cl. ..... 400/250; 400/208

[58] Field of Search ..... 400/208, 250, 208.1, 400/234, 207, 248; 226/91; 242/55.19 A, 197–199

[56] References Cited

U.S. PATENT DOCUMENTS

| | | | |
|---|---|---|---|
| 2,941,741 | 6/1960 | Bilsback | 242/199 |
| 3,396,828 | 8/1968 | Moshier et al. | 400/248 |
| 3,415,349 | 12/1968 | Sato et al. | 400/248 |
| 3,710,915 | 1/1973 | Teichmann et al. | 400/234 |
| 3,902,680 | 9/1975 | Neff | 226/91 |
| 3,945,582 | 3/1976 | Yagi et al. | 242/55.19 A |
| 3,977,511 | 8/1976 | Hengelhaupt | 400/250 |

FOREIGN PATENT DOCUMENTS

| | | | |
|---|---|---|---|
| 2539904 | 4/1977 | Fed. Rep. of Germany | 400/250 |

*Primary Examiner*—William Pieprz

*Attorney, Agent, or Firm*—Sprung, Horn, Kramer & Woods

[57] ABSTRACT

A ribbon cartridge construction and a ribbon cartridge loading adapter for use with a ribbon cartridge having a substantially planar top surface. The adapter has a substantially planar body portion and is cooperative with the top surface of the ribbon cartridge for slidably mounting same on the top surface of the ribbon cartridge for movement between an extended and a retracted position. The adaptor has two substantially planar spaced apart arms extending outwardly from the body portion parallel thereto and has downwardly depending portions at the termini thereof for releasably retaining a run of ribbon for insertion in a ribbon guide when in the extended position.

8 Claims, 8 Drawing Figures

RIBBON CARTRIDGE AND ADAPTER

BACKGROUND OF THE INVENTION

The present invention relates to a ribbon cartridge and an adapter for effecting the loading of same.

Ribbon cartridges for typewriters and word processing equipment are well known and have a variety of outward configurations and internal mechanisms, depending upon the machine in which they are to be used. A common problem that occurs in the use of ribbon cartridges, especially of the single use ribbon cartridge, is the maintaining of a proper tension on the ribbon so that the ribbon does not jam during its advance and such that the ribbon is effectively and efficiently utilized by the printing equipment.

The current state of the art in ribbon cartridges effects the tensioning of the ribbon by providing a soft sponge-like member on one of the inner flat surfaces of the ribbon cartridge which extends radially with respect to the ribbon at the supply side of the cartridge and which contacts the ribbon during use to exert a frictional force on the ribbon which prevents the ribbon from freely rotating while not preventing advancement of the ribbon by the printing mechanism.

At the same time, a tensioning mechanism in the form of a spring or the like biases the ribbon at the supply side of the cartridge and before the ribbon extends through the outlet of the cartridge so that the ribbon is properly taut during its use. The advancing mechanism acting on the take-up spool or transmission mechanism of the ribbon works in conjunction with the tensioning member to keep the ribbon taut during advancement and use.

The friction applying member of the prior art has the disadvantage of exerting an uneven force on the ribbon spool during use since the sponge-like member is directed radially across the ribbon spool and thus as the ribbon spool unwinds, the force exerted on the spool decreases. Moreover, the adding of the sponge-like member to the cartridge housing becomes expensive due to the fact that the cartridge housing, conventionally made of a single piece of molded plastic, necessitates the further manual manufacturing operation of applying an adhesive and placing the sponge-like member in its proper location.

Other conventional cartridges are known which have a substantially rectangular configuration and wherein the ribbon inlet and outlet apertures are spaced a substantial distance from the feed mechanism for the particular printing mechanism of the typewriter or word processing apparatus. In use, after the cartridge is mounted in place in the apparatus, the user must thereafter manually guide the ribbon into the printing mechanism, usually resulting in a loss of time and the soiling of the users hands.

SUMMARY OF THE INVENTION

The main object of the present invention is to overcome the disadvantages of prior art ribbon cartridges.

Another object of the present invention is to provide a ribbon core holder for ribbon cartridge which is of simple and inexpensive construction and which applies a constant force on the ribbon core and spool independent of the amount of ribbon left thereon during use.

A further object of the present invention is to provide an adapter for use with ribbon cartridges which enable the cartridges to be loaded in such a manner which reduces the amount and nature of the manual operations needed with the conventional cartridges and apparatus.

These and other objects of the present invention are achieved in accordance with the present invention by a ribbon cartridge of the type having a ribbon core holder rotatably receptive of a ribbon wound around a substantially cylindrical hollow ribbon core, wherein the ribbon core holder includes means for applying a force on the inner surface of the ribbon core directed radially outwardly with respect to the axis of rotation to prevent free rotation of the wound ribbon during use of the cartridge.

The force applying means comprises a first fixedly mounted longitudinally segmented cylindrical member having a smaller radius than the inner radius of the ribbon core and an elastically deformable second member having a portion thereof spaced radially from the axis of the first member, when in its equilibrium position, by a distance greater than the inner radius of the ribbon core. The second member can be made from a member which extends parallel to the axis of the first member and which has a radially extending projection at one end thereof spaced sufficiently far so that it is at a distance greater than the inner radius of the ribbon core. Alternatively, the second member can extend radially outwardly from the axis of the first member at an acute angle such that in its equilibrium position a portion thereof is at a distance greater than the inner radius of the ribbon core.

In a particularly advantageous commercial embodiment, the cartridge comprises a plastic housing and the first and second members comprise plastic and are integral with the housing.

Further in accordance with the present invention, a ribbon cartridge loading adapter comprises a substantially planar body portion having means for slidably mounting same on the top surface of a ribbon cartridge and two substantially planar spaced apart arms extending outwardly from the body portion parallel thereto and having downwardly depending means at the termini thereof for releasably retaining a run of ribbon.

The mounting means comprise two tabs which extend downwardly from the body portion and engage in corresponding slots in the top surface of the cartridge. The tabs have slots therein so as to engage the top surface of the cartridge in the extreme forward position to prevent an upward removal of the adapter during use.

The retaining means comprises channels associated with each arm each having a depth greater than the thickness of a ribbon and a gradually decreasing width which at its widest is slightly greater than the width of the ribbon and at its narrowest it is slightly smaller than the width of the ribbon. This enables the adapter to hold the ribbon in place while it is guided onto the printing mechanism and to easily release same in response to a rearward movement of the adapter.

These and other objects and advantages of the present invention will become apparent from the following description when read in conjunction with the accompanying drawings wherein:

DETAILED DESCRIPTION OF THE PREFERRED EMBODIMENTS

Figure 1:
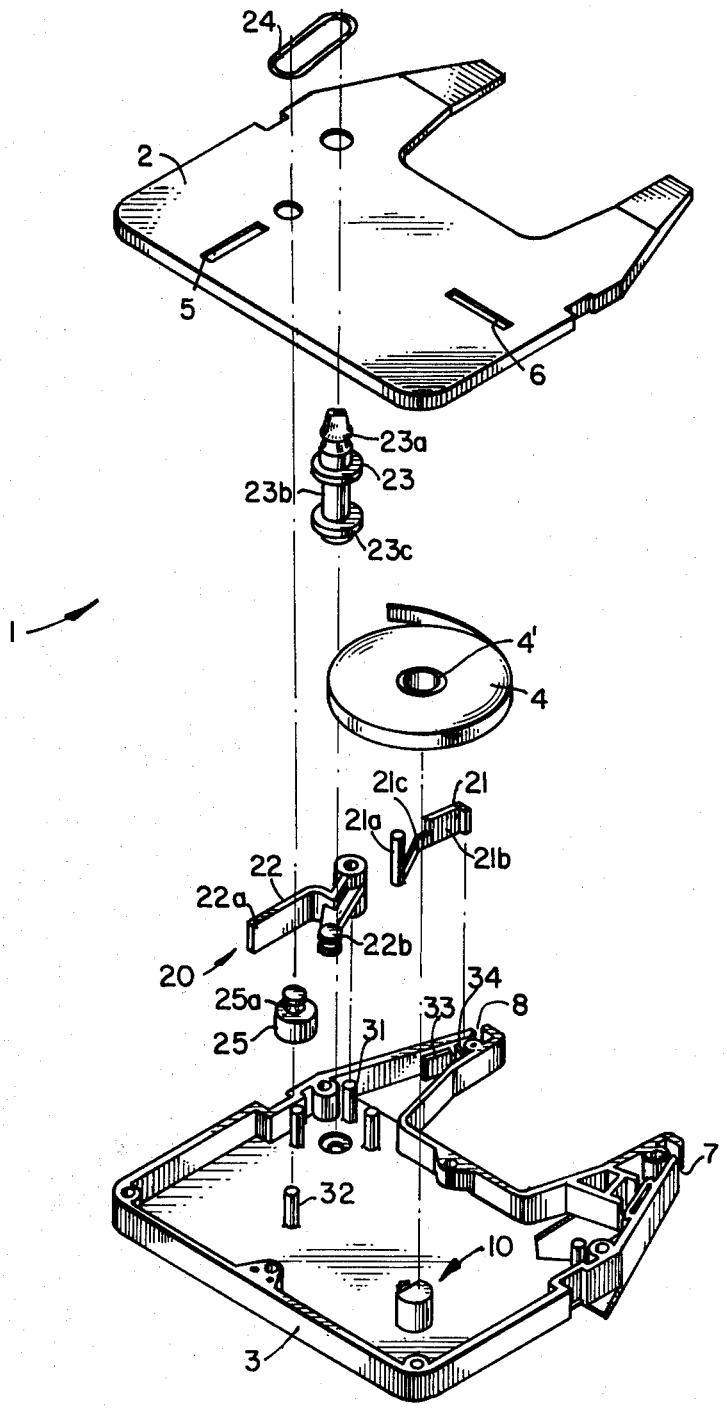
FIG. 1 is an exploded view of a ribbon cartridge according to the present invention.
Figure 2:
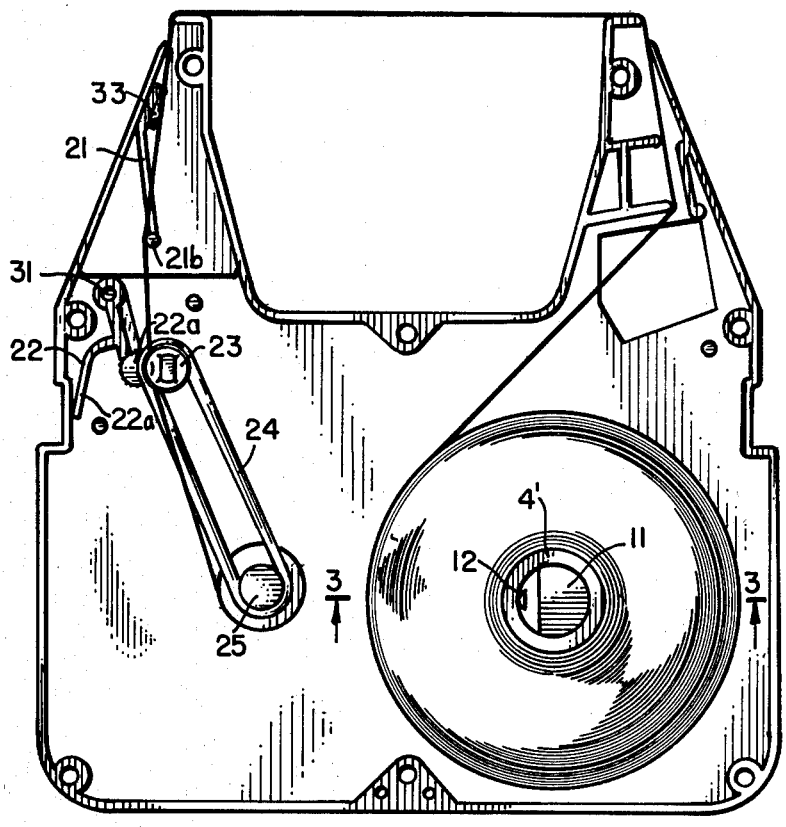
FIG. 2 is a top view of the cartridge of FIG. 1 with the top removed.
Figure 3:
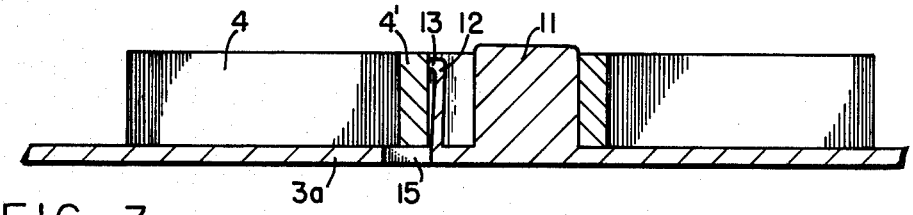
FIG. 3 is a sectional view along line 3—3 of FIG. 2.

Referring now to FIGS. 1–3, the present invention is shown as it would appear in an otherwise conventional ribbon cartridge.

The cartridge 1 according to the present invention is preferably constructed of rigid plastic and includes an upper or top portion 2 and a bottom portion 3 which are joined together along the periphery thereof in a conventional manner by means of cement or other conventional connecting means. The cartridge housing portions 2, 3 hold a ribbon spool 4 wound around a ribbon core 4' which is conventionally a hollow substantially cylindrical member which rotates within the cartridge during use to feed ribbon to a printing mechanism.

The ribbon core 4' is rotationally received on the ribbon core holder 10, which includes means for applying a radially outwardly directed force on the ribbon core 4' from within as will be explained in more detail hereinafter. The bottom portion 3 of the cartridge housing includes a ribbon outlet aperture 7 and a ribbon inlet aperture 8 which are spaced apart and which enable a run of ribbon to be guided outwardly of the cartridge for use by a printing mechanism. The ribbon, after entering the cartridge at the inlet aperture 8, is thereafter taken up on a take-up spool 25 which will be explained in detail hereinafter.

The top portion 2 of the ribbon cartridge includes apertures 5 and 6 which permit the visual indication as to the remaining amount of ribbon on the ribbon core 4' or the amount of ribbon that has been taken up on the take-up spool 25.

The take-up mechanism 20 of the ribbon cartridge acts in conjunction with the ribbon advance mechanism of a printing apparatus to advance the ribbon during use.

The take-up spool 25 is mounted on a post 32 on the bottom portion 3 of the cartridge housing and operates in conjunction with a member 23 which is driven at its lower portion 23*c* by the printing mechanism, and which has its central portion 23*b* in contact with the ribbon and an upper portion 23*a* which receives a transmission belt 24 which rotationally connects member 23 with member 25 so that the two rotate together when member 23 is driven by the printing mechanism.

In order to ensure that the ribbon is properly pulled to advance same, member 22 is provided which is pivoted about member 31 mounted on the bottom portion 3 of the cartridge housing and which includes a portion 22*a* which bears against the side of the housing and a portion 22*b* which is knurled and which abuts against central portion 23*b* with the ribbon therebetween. The member 22*b* is rotationally mounted and thus upon rotation of the member 23 and the biasing force exerted by the springing action of portion 22*a*, the ribbon is effectively advanced.

In accordance with the present invention the means including members 11 and 12 applies a force to the ribbon core 4' in order to prevent its free rotation during use. As a result of that force and the pulling force applied by the take-up mechanism 20, the ribbon is advanced in a reliable manner. However, it is also necessary to provide a certain degree of tension to the ribbon so as to ensure its tautness during the advance. This is carried out by the tension member 21 which includes a mounting portion 21*b* which is held in place by members 33, 34 which are fixedly mounted on the bottom portion 3 of the cartridge housing. Tension member 21 also includes a bearing portion 21*a* which is substantially cylindrical in shape and which, in its equilibrium position, traverses the ribbon path so that the ribbon bears on members 21*a* tending to move it in the counterclockwise direction. As a result of the central portion 21*c* which acts as a spring and thus exerts an opposite force due to its elastic behavior, portion 21*a* exerts a tension force on the ribbon to maintain it in the taut condition even when there are fluctuations in the pulling force exerted on the ribbon by the take-up mechanism 20.

The member 21 can be made of spring-like metal or preferably composed of a plastic such as nylon.

Referring now to FIGS. 2–5, the ribbon core holder according to the present invention is shown in detail.

In the embodiment shown in FIGS. 2 and 3, the ribbon core holder includes means for applying a force on the inner surface of the ribbon core 4' directed radially outwardly with respect to the axis of rotation to prevent free rotation of the wound ribbon 4 during use of the cartridge. This means includes the fixedly mounted longitudinally segmented cylindrical member 11 which has a smaller radius than the inner radius of the ribbon core 4'. In practice, the radius of member 11 should only be slightly smaller than the radius of the core 4' so as to enable free rotation but for the force exerted by member 12 which is described hereinafter.

The member 12 is mounted on the bottom portion 3 of the housing so as to be elastically deformable. It is configured so as to exert the radially outwardly directed force in alternative manners as shown in FIGS. 2–5.

In FIGS. 2 and 3, member 12 is disposed so that its longitudinal axis is parallel to the longitudinal axis of member 11 but it has a projection 13 at the top portion thereof which at its outermost extends radially outwardly at a distance greater than the inner radius of the core 4'. As a result, when the ribbon core is placed on the core holder 10, member 12 is elastically deformed radially inwardly and due to this elastic deformation, exerts a radially outwardly directed force on the inner surface of the core 4'.

Figure 4:
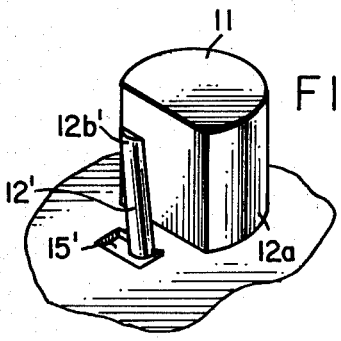
FIG. 4 is a perspective view of an alternative embodiment of the ribbon core holder according to the present invention.

In FIG. 4, an alternative embodiment is shown wherein the same segmented cylindrical member 11 is utilized, however the member 12' is utilized which is disposed, in its equilibrium position, at an acute angle with respect to the longitudinal axis of the member 11. The member 12' is so disposed that at its lower most portion 12*a*', it is set back at a distance which is less than the inner radius of the core 4' and at its top most portion 12*b*', it extends at a distance greater than the inner radius of the core 4'. As a result, when the core 4' is mounted on the core holder, the member 12' will exert an outwardly radial force due to the fact that it is elastically deformable.

Figure 5:
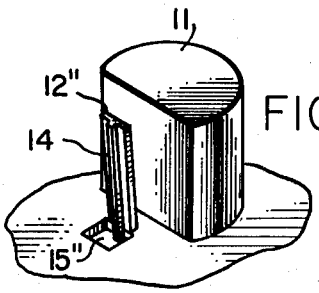
FIG. 5 is a perspective view of a further embodiment of the ribbon core holder according to the present invention.

In FIG. 5, member 12″ is provided which has the same angled configuration as that of 12′, but includes a strengthening rib 14 extending along the length thereof.

In all of the embodiments shown in FIGS. 1–5, it has been found that a particularly advantageous commercial embodiment comprises the members 11, 12, 12′, 12″ as being molded from the same piece of plastic as the bottom housing portion 3 such that members 11, 12, 12′, 12″ are integral therewith in a unitary construction. When such a construction is carried out, the plastic is taken from the planar surface of portion 3 such that apertures 15, 15′ and 15″ are present in the embodiments shown in FIGS. 3–5 respectively.

Figure 6:
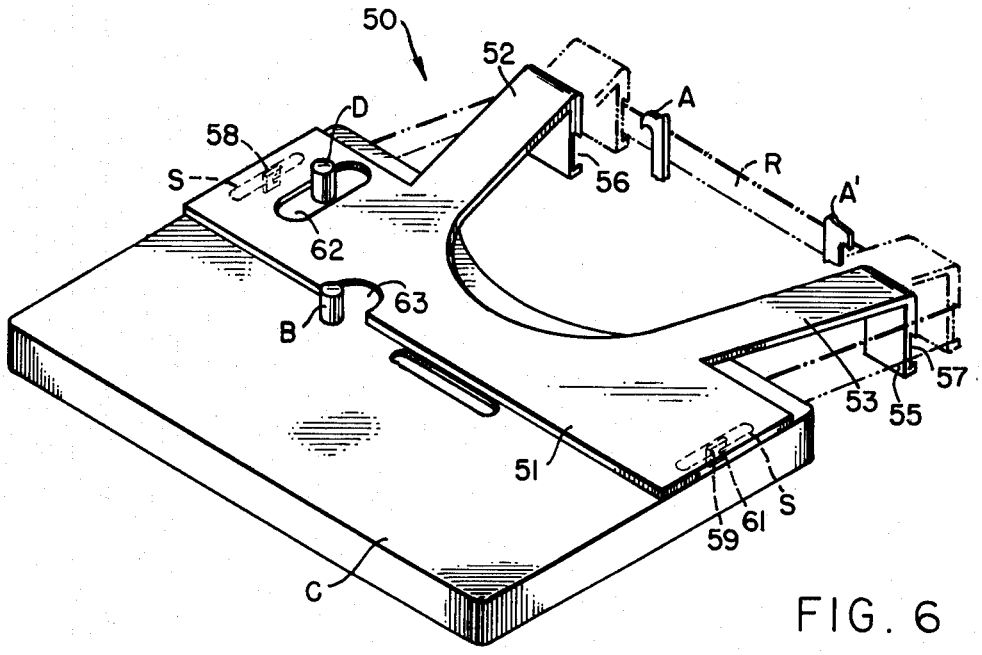
FIG. 6 is a perspective view of the ribbon cartridge loading adapter according to the present invention.
Figure 7:
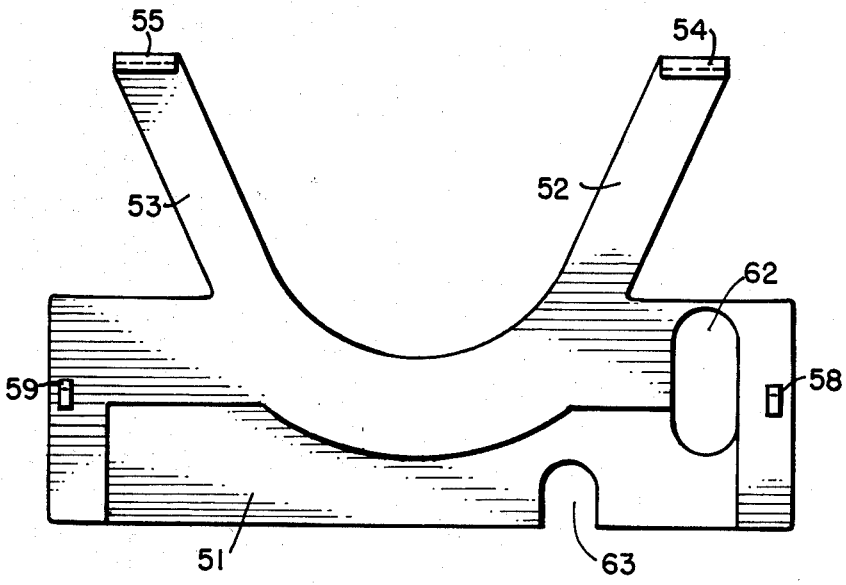
FIG. 7 is a bottom view of the adapter of FIG. 6.
Figure 8:
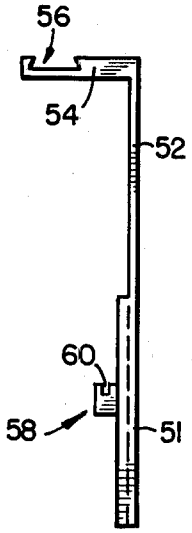
FIG. 8 is a side view of the adapter of FIG. 6.

Turning now to FIGS. 6–8, the ribbon cartridge loading adapter 50 according to the present invention is shown as comprising a substantially planar body portion 51 and two outwardly extending arms 52, 53 which are substantially planar and are spaced apart and parallel to the body 51.

The arms 52, 53 include at the termini thereof, means 54, 55 for releasably retaining a run of ribbon. The means 54, 55 extend downwardly from the arms 52, 53 and generally perpendicular thereto and include means defining channels 56, 57 therein which are configured to hold a ribbon R. The channels 56, 57 are configured to have a depth greater than the thickness of a ribbon and a gradually decreasing width which, at its widest, is slightly greater than the width of the ribbon and at its narrowest, is slightly smaller than the width of the ribbon.

The body 51 is configured to be slidably mounted on the top surface of ribbon cartridge C. This is carried out by means including tabs 58, 59 which extend downwardly from the base 51 and which are slidably received in slots S in the top surface of the cartridge C. The tabs 58, 59 also include notches 60, 61 which have a width which is slightly greater than the thickness of the top surface of the housing of cartridge C so that when the adapter 50 is slid to the forwardmost position as shown in the dotted lines of FIG. 6, the slots engage with the upper surface of the cartridge C so as to prevent any undesired upward removal of the adapter.

The base portion 51 also includes cutouts 62, 63 which enable the adapter to be placed on a particular cartridge having an obstruction D, B projecting therefrom so as to enable the adapter to be used without any difficulty.

In use, the adapter 50 can be sold with a particular cartridge C by the manufacture with the cartridge C in its forward most position (shown in dotted lines in FIG. 6) and with the ribbon run R disposed within the channels 56, 57. Alternatively, the cartridge C can be sold in its conventional configuration and the user can insert the ribbon run R into the channels 56, 57 and thereafter slide tabs 58, 59 into slots S until the adapter 50 is in its forwardmost position.

In any event, the cartridge with the adapter attached thereto as shown in FIG. 6 in dotted lines is mounted into position in the typewriter or word processing apparatus in its normal position. The arms 52, 53 are configured so that the run of ribbon R is spaced apart from the cartridge C and the channels 56, 57 are so spaced so as to be outwardly of the guide members A, A′ of the printing mechanism and to dispose the ribbon R in the proper position in front of the guide members A, A′.

Thereafter, the adapter 50 is slid rearwardly to the position shown in solid lines whereby the ribbon which is now held in place by the guide mechanism A, A′, will deflect and pull out of the channels 56, 57. Simultaneously, the notches 60 are disengaged from the top surface of the cartridge C so that the adapter can be upwardly removed. As a result, the cartridge is now completely loaded in the machine without the necessitity of the user handling the ribbon.

It will be apparent to one skilled in the art that the adapter according to the present invention is to be utilized with cartridges of any type wherein provision is not made, such as in the cartridge of FIG. 1, for guiding the ribbon at the outlet and inlet apertures of the cartridge to a position wherein no further extension is needed in order to load the ribbon. Since particular cartridge types are used with a given machines or mechanisms, it will be easy for one skilled in the art to modify the outward extent of the arms 52, 53 and the spacing therebetween in order to tailor the adapter for a particular type of cartridge. Moreover, the particular types of cutouts 62, 63 on the body portion thereof are dictated by the types of obstructions B, D existing on a given cartridge and thus one skilled in the art could easily modify the adapter to suit any type of cartridge configuration.

Further, it is clear that the only modification needed to a standard cartridge to make it lend itself to be used with the adapter 50 according to the present invention is the provision of the slots S therein. These slots in no way would interfere with the operation of the cartridge and as a result conventional cartridge types can be easily modified to accept the adapter.

It should be clear to one skilled in the art that the ribbon core holder according to the present invention along with the tension device can be utilized in any conventional ribbon cartridge and is not limited to the embodiment shown in FIG. 1. For example, the ribbon core holder according to the present invention can be easily utilized in a cartridge such as that shown in FIG. 6 and the tension member 21 can be easily utilized in other cartridge configurations and it would only be a matter of routine to place the tension device in the appropriate location on the take-up side of a cartridge given the particular transmission mechanism therein.

It will be appreciated that the instant specification and claims are set forth by way of illustration and not limitation, and that various modifications and changes may be made without departing from the spirit and scope of the present invention.

What is claimed is:

1. A ribbon cartridge loading adapter for use with a ribbon cartridge having a substantially planar top surface, the adapter comprising: a substantially planar body portion having means cooperating with the top surface of the ribbon cartridge for mounting same on the top surface of a ribbon cartridge for movement between extended and retracted positions and two substantially planar spaced apart arms extending outwardly from the body portion parallel thereto and having downwardly depending means at the termini thereof for releasably retaining a run of ribbon.

2. The adapter according to claim 1, wherein the mounting means comprise two tabs extending downwardly from the body portion towards the top surface of the cartridge for insertion in corresponding slots therein.

3. The adapter according to claim 2, wherein the tabs have slots therein in the sides facing the arms for coacting with the upper surface of the cartridge to permit the sliding of the body portion to an extreme forward position to prevent the upward removal of the adapter.

4. The adapter according to claim 1, wherein the retaining means comprises means defining a channel associated with each arm and having a depth greater than the thickness of a ribbon and a gradually decreasing width which at its widest is slightly greater than the width of the ribbon and at its narrowest it is slightly smaller than the width of the ribbon.

5. A ribbon cartridge construction for use in a printing machine having a ribbon guide comprising: a ribbon cartridge housing having a substantially planar top surface and one side wall having a ribbon inlet and a ribbon outlet aperture; and a loading adapter comprising a substantially planar body portion, two substantially planar spaced apart arms extending outwardly from the body portion parallel thereto and having downwardly depending means at the termini thereof for releasably retaining a run of ribbon and means mounting the planar body portion on the top surface of the ribbon cartridge housing with the arms extending outwardly from said one side wall to space the releasable retaining means a selected distance apart from the inlet and outlet apertures to position the run of ribbon about the ribbon guide when the cartridge is placed in the printing machine.

6. The cartridge construction according to claim 5, wherein the mounting means comprises two tabs extending downwardly from the body portion towards the top surface of the cartridge housing and corresponding slots in the top surface of the cartridge housing.

7. The cartridge construction according to claim 6, wherein the tabs have slots therein in the sides thereof facing the arms for coacting with the upper surface of the cartridge housing to prevent upward movement of the adapter relative to the cartridge housing.

8. The cartridge construction according to claim 5, wherein the retaining means comprises means defining a channel associated with each arm and having a depth greater than the thickness of a ribbon to be retained and a gradually decreasing width which at its widest is slightly greater than the width of the ribbon and at its narrowest it is slightly smaller than the width of the ribbon.

* * * * *